United States Patent [19]

Dobrin

[11] Patent Number: 4,464,293

[45] Date of Patent: Aug. 7, 1984

[54] LIQUID CLEANER-DISINFECTANT COMPOSITION FOR USE IN WIPING DOWN DENTAL OPERATORIES

[76] Inventor: Robert J. Dobrin, 4 Nancy La., Framingham, Mass. 01701

[21] Appl. No.: 367,285

[22] Filed: Apr. 12, 1982

[51] Int. Cl.[3] ..... C11D 1/62

[52] U.S. Cl. ..... 252/547; 252/153; 252/106; 252/162; 252/173; 252/DIG. 5

[58] Field of Search ..... 252/547, 153, DIG. 5, 252/106, DIG. 14, 173, 162, 174.21, 174.22, DIG. 1

[56] References Cited

U.S. PATENT DOCUMENTS

| | | | |
|---|---|---|---|
| 2,942,008 | 6/1960 | Lubowe | 252/106 |
| 3,624,224 | 11/1971 | Watchung et al. | 252/106 |
| 3,708,435 | 1/1973 | Starkman | 252/DIG. 5 |
| 3,943,234 | 3/1976 | Roggenkamp | 252/DIG. 5 |
| 3,965,026 | 6/1976 | Lanz | 252/547 |
| 4,154,706 | 5/1979 | Kenkare et al. | 252/547 |
| 4,210,654 | 5/1980 | Bauer et al. | 252/547 |
| 4,247,424 | 1/1981 | Kuzel et al. | 252/153 |
| 4,292,211 | 9/1981 | Herman | 252/153 |

OTHER PUBLICATIONS

Ammonyx LO, BTC2125M, Triton X-100, McCutcheon's Detergent X Emulsifiers pp. 60, 76, 269, 1978 North American Ed. McCutcheon Div., MC Publ. Co., Glen Rock, N.J.

*Primary Examiner*—John E. Kittle
*Assistant Examiner*—Hoa Van Le
*Attorney, Agent, or Firm*—Irving M. Kriegsman

[57] ABSTRACT

A liquid composition formulated especially for use in wiping down non-disposable surfaces in a dental operatory is disclosed. The composition consists essentially of between 50 and 91% by volume of isopropyl alcohol, between 0.5 and 1.5% by volume of a skin emollient, between 0.19 and 2.5% by volume of a scent, between 0.3 and 1.5% by volume of a cationic detergent, between 0.5 and 8% by volume of an nonionic detergent and the remainder up to 100% by volume of water. The alcohol acts as a disinfectant, the skin emollient prevents drying of the skin, the scent masks the smell of the alcohol, the two detergents act as cleaning agents and the water serves as a carrier to cut the proportions of the various ingredients that make up the composition.

2 Claims, No Drawings

LIQUID CLEANER-DISINFECTANT COMPOSITION FOR USE IN WIPING DOWN DENTAL OPERATORIES

BACKGROUND OF THE INVENTION

The present invention relates to a liquid composition formulated especially for use in wiping down non-disposable surfaces in a dental operatory.

In many dental procedures, such as drilling, an aerosal spray is often directed into the mouth of a patient. In doing this, bacteria is picked up from the patient's mouth by the spray and spread around the operatory. Also, in the course of treating a patient a dentist may place one or both of his hands inside a patient's mouth and then touch a non-disposable surface in the operatory without first wiping his hands clean, causing bacteria to be transferred from the patient's mouth to that surface. In any event, in order to avoid the possibility of cross-contamination between patients and also to maintain a generally clean environment in the operatory, it has become standard practice among dentists to wipe down non-disposable surfaces that may be touched (i.e. table tops, counter tops, switches) with a disinfecting solution consisting of about 70% by volume of alcohol and about 30% by volume of water at regular intervals, preferably between patients. The solution is applied to the surfaces with a small gauze pad which is held in the hand of the user and then thrown away after use. For convenience, a number of gauge pads presoaked in the solution are usually maintained in a container and then taken out, one at a time, when needed.

One of the problems with this type of wiping solutions is that although the alcohol acts as a disinfectant and will destroy bacteria it is not a detergent and thus not a very efficient cleaner. Consequently, it is not entirely satisfactory for removing dirt, ink, blood or various chemicals used by the dentist which may for one reason or another collect drop or fall onto a non-disposable surface. Another problem with a solution of alcohol and water is that the alcohol has a sharp medicinal smell which permeates the area over which it is applied for some time. The smell may induce a patient to salivate or otherwise adversely effect the patient's state of relaxation. Still another problem with an alcohol and water solution is that when the alcohol contacts the hands of a user it has a tendency to dry the skin.

As can be appreciated the need exits for an improved liquid composition for use in wiping down non-disposable surfaces in a dental operatory.

Accordingly, it is an object of this invention to provide a liquid composition for use in wiping down non-disposable surfaces in a dental operatory.

It is another object of this invention to provide a liquid composition as described above which contains a detergent as well as a disinfectant.

It is another object of this invention to provide a liquid composition as described above which contains alcohol but does not have a medicinal smell.

It is a further object of this invention to provide a liquid composition as described above which contains alcohol but will not dry the skin of the hands of the user.

SUMMARY OF THE INVENTION

A liquid composition for use in wiping down non-disposable surfaces in a dental operatory according to the teachings of the present invention consists essentially of a quantity of alcohol which acts as a disinfectant, a skin emollient to prevent drying of the skin when it comes into contact with the alcohol and a scent to mask off the medicinal smell of the alcohol. In addition, the composition may include a cationic detergent which acts as a cleaning agent and an nonionic detergent which also acts as a cleaning agent and water.

The foregoing and other objects and advantages will appear from the description to follow. In the description, specific examples and embodiments for practicing the invention are described. These examples and embodiments will be described in sufficient detail to enable those skilled in the art to practice the invention, and it is to be understood that other embodiments may be utilized and that changes may be made without departing from the scope of the invention. The following detailed description is, therefore, not to be taken in a limiting sense, and the scope of the present invention is best defined by the appended claims.

DETAILED DESCRIPTION OF PREFERRED EMBODIMENTS

The present invention is directed to a liquid composition formulated especially for use in wiping down non-disposable surfaces of a dental operatory which functions as a cleaner as well as a disinfectant, which does not have a medicinal smell and which does not dry the skin when it comes into contact with the hands of the user.

The present invention accomplishes this by providing a liquid composition which includes in addition to alcohol, in an amount sufficient to function as a disinfectant, at least one detergent, a scent and a skin emollient. The alcohol is either ethyl or isopropyl alcohol and is between 50 and 91% by volume of the composition. The skin emollient is between 0.5 and 1.5% by volume of the composition and serves to prevent drying of the skin that comes into contact with the composition during use. An example of a skin emollient suitable for this purpose is AMMONYX-LO manufactured by Onyx Chemical Corporation of Jersey City, N.J. Other emollients which may be used include lanolyn, glycerine and cetyl alcohol. The scent is between 0.19 and 2.5% by volume of the composition and serves to blunt or mask the medicinal smell of the alcohol. The scent may be, for example, an herbal scent manufactured by Shaw Mudge and Company of Stamford, Conn. The composition preferably includes two detergents, one cationic which serves to some extent as a disinfectant as well as a cleaning agent and the other nonionic which serves as a cleaning agent. The cationic detergent may be a quaternary ammonium compound and is between 0.3 and 1.5% by volume of the composition. An example of a cationic detergent is benzalkonium chloride, known as BTC-2125 manufactured by Onyx Corporation of Jersey City, N.J. The nonionic detergent is between 0.5 and 8% by volume of the composition. An example of an nonionic detergent is TRITON X-100 manufactured by Rohm and Haas.

EXAMPLES

The following examples further define and describe the composition, manner of preparation and its characteristics.

EXAMPLE I

The following materials were mixed together:

| | |
|---|---|
| Isopropyl alcohol | 163 lbs. |
| Herbal scent | 0.72 lbs. |
| Benzalkonium chloride | 0.78 lbs. |
| Triton X-100 | 3.05 lbs. |
| Water | 87.5 lbs. |
| Ammonyx L-O | 4.3 lbs. |

The herbal scent and Triton X-100 were first mixed together separately. The resulting mixture and the other materials were then poured into a tub and stirred for about five seconds. The composition had a pleasant scent, did not dry the skin, had minimal streaking and appeared to clean reasonably well.

EXAMPLE II

The following materials were mixed together:

| | |
|---|---|
| Glycol ether | 0.5% by volume |
| Ethylene diamine tetra acetic acid (EDTA) | 3% by volume |
| Triton X-100 | 6% by volume |
| Ammonyx -LO | 2% by volume |
| Benzalkonium chloride | 0.3% by volume |
| Isopropyl alcohol | 70% by volume |
| Water | remainder to 100% by volume |

Result: The solution streaked and caused distress to observers.

EXAMPLE III

| | |
|---|---|
| Isopropyl alcohol | 60% by volume |
| Triton X-100 | 1% by volume |
| EDPA | 1% by volume |
| Ammonyx L0 | 1.5% by volume |
| Benzalkonium chloride | 0.3% by volume |
| Water | Remainder up to 100% by volume |

Result: The solution dried too slowly when applied to a surface.

EXAMPLE IV

Same as Example I except that the scent was 0.1% by volume. Result: The scent did not adequately mask the smell of the alcohol.

EXAMPLE V

Same as Example I except that scent was 5% by volume. Result: The scent was too strong.

EXAMPLE VI

Same as Example I except that emollient was glycerine. Result: Streaked too much when applied to surface.

It is to be understood that although the solution has been described with reference to cleaning non-disposable surfaces in a dental operatory, the solution may, of course be used for cleaning surfaces in places other than dental operatories.

Although a particular embodiment of the invention has been described and illustrated herein, it is recognized that modifications and variations may readily occur to those skilled in the art and consequently, it is intended that the claims be interpreted to cover such modifications and equivalents.

What is claimed is:

1. A liquid composition for use in wiping down non-disposable surfaces in a dental operatory consisting essentially of:

a. between about 50 and 91% volume of a $C_1$–$C_4$ alcohol, b. between about 0.5 and 1.5% by volume of a skin emollient, c. Between about 0.19 and 2.5% by volume of a scent, d. between about 0.3 and 1.5% by volume of a cationic detergent, e. between about 0.5 and 8% by volume of a nonionic detergent, and f. the remainder up to 100% by volume of water.

2. The composition of claim 1 and wherein the alcohol is isopropyl alcohol the skin emollient is lauryl dimethylamine oxide, the scent is an herbal scent, the cationic detergent is benzalkonium chloride and the nonionic detergent is octylphenoxy polyethoxy ethanol.

* * * * *